US005653036A

United States Patent [19]

Dansereau

[11] Patent Number: 5,653,036

[45] Date of Patent: Aug. 5, 1997

[54] DROP FINDER

[76] Inventor: Mark D. Dansereau, 36 Country Club Hts., Monson, Mass. 01057

[21] Appl. No.: 562,421

[22] Filed: Nov. 24, 1995

[51] Int. Cl.[6] ..... B25H 7/04

[52] U.S. Cl. ..... 33/529; 33/520; 33/666; 33/579

[58] Field of Search ..... 33/579, 577, 574, 33/666, 670, 677, 529, 516, 1 G, 166, 332, 809, 644

[56] References Cited

U.S. PATENT DOCUMENTS

| | | | |
|---|---|---|---|
| 160,471 | 3/1875 | Robinson | 33/666 |
| 375,795 | 1/1888 | Beyerle | 33/520 |
| 2,245,646 | 6/1941 | Bullivant | 33/579 |
| 2,314,149 | 3/1943 | Lipscomb et al. | 33/520 |
| 3,407,509 | 10/1968 | Martinez | 33/666 |
| 3,808,690 | 5/1974 | Balder | 33/1 CC |
| 4,141,147 | 2/1979 | Klassen et al. | 33/529 |
| 4,202,108 | 5/1980 | Adams, Jr. | 33/579 |
| 5,155,917 | 10/1992 | Townsend et al. | 33/809 |
| 5,241,756 | 9/1993 | King | 3/516 |

FOREIGN PATENT DOCUMENTS

| | | |
|---|---|---|
| 46103 | 3/1980 | Japan . |
| 196978 | 8/1991 | Japan . |

*Primary Examiner*—Thomas B. Will
*Attorney, Agent, or Firm*—Deborah A. Basile, Esq.

[57] ABSTRACT

The invention is a device used to mark a point in connection with the installation of an indoor sprinkler system in a ceiling or wall such that the device is connected to installed sprinkler system piping and the telescopic pointer is extended to the necessary length to mark a point in the ceiling or wall where the sprinkler head should be installed or where connector piping should be installed.

3 Claims, 2 Drawing Sheets

DROP FINDER

TECHNICAL FIELD

The invention is a device used by the installer of an indoor ceiling or wall sprinkler system to find a center mark such that pipes from the system will line up with the hole drilled in the wall or ceiling for the sprinkler head.

I. BACKGROUND OF THE INVENTION

The present invention relates to a device used in the installation of an indoor sprinkler system to locate the point on a ceiling or wall where the plumbing for the sprinkler system will intersect for purposes of installation of the sprinkler head or additional plumbing. The invention allows the installer to drill a hole in the ceiling or wall knowing that the pipe for the system will always be centered within the hole and allows the installer to perform this function in significantly less time than present methods. Other less efficient methods include a plumb-bob, or a device employing a level which must be held in place until the level is found before the point can be identified. All prior methods are less accurate and more time consuming for the installer. When a sprinkler system is installed into a building which is kept at below freezing temperatures, such as a warehouse for meat or perishables or in a supermarket or distribution center, the system must be installed dry, without water. The dry system is filled with air and when the system is triggered, the air is released which triggers the water supply to send water into the system. The plumbing of the dry system must be pitched so as to allow the water to run into the system and through the sprinkler heads when needed. The present invention is very useful in installing a pitched system A dry sprinkler system is filled with air rather than water to prevent freezing. Because the plumbing lines are pitched, the one inch outlets for the drops are not plumb. So the use of a plumb-bob would be totally inaccurate and measuring the spot would be mostly guess work because the installer does not know the actual angle of the pipe. The present invention can be installed and extended to mark the point according to any degree of pitch.

The only other accurate way would be to use a piece of pipe cut to the approximate length from the outlet to the ceiling, install it, then mark the ceiling. That option can be very clumsy. Also, the lengths change as you go down the line because of the pitch, so different lengths of pipe would be needed which would be cumbersome.

A primary feature of the present invention is that it has at one end a one-inch national pipe thread (N.P.T.) male thread pipe which engages onto the one inch diameter outlet pipe and is therefore connected such that the installer has two free hands with which to mark the point. The main body assembly of the invention consists of a telescopic shaft which extends from as small as five inches to 25 inches or longer, as needed. The main body assembly has within it shaft retainers which keep the telescopic shaft aligned within the main body assembly. The point at which the point implement at the end of the telescopic shaft reaches the ceiling or wall is where the mark is made. The installer makes the mark by applying pressure to the pressure ring causing the point implement to cause an indentation in the ceiling or wall. The point implement may also contain means for a writing utensil whereby the mark is made with ink on the ceiling or wall. The installer then disconnects the device from the pipe and drills the hole. It is therefore unnecessary for the installer to create a level point or a plumb-bob point and there is no actual measurement which must be done.

The object of the invention is to provide a device which easily allows an installer to locate a point on the ceiling or wall which is accurate and which does not involve time-consuming measurement. By eliminating measurement, human error is eliminated, and therefore waste of materials and time is eliminated.

II. SUMMARY OF THE INVENTION

The invention consists of a main body assembly, containing within same, a collapsible, telescopic shaft made of metal or fiberglass or plastic which extends from a fixed length when closed to any length when extended. When closed, extending slightly from the end of the main body assembly, the telescopic shaft has a marking point implement and a pressure ring. When used, the installer will apply pressure on the pressure ring towards the wall or ceiling using the marking point implement to penetrate the wall or ceiling and/or mark a point on the wall or ceiling. The other end of the main body assembly has a one-inch national pipe thread N.P.T. male thread which screws into the piping of the sprinkler system.

III. BRIEF DESCRIPTION OF THE DRAWINGS

IV. DESCRIPTION OF THE PREFERRED EMBODIMENT

Figure 1:
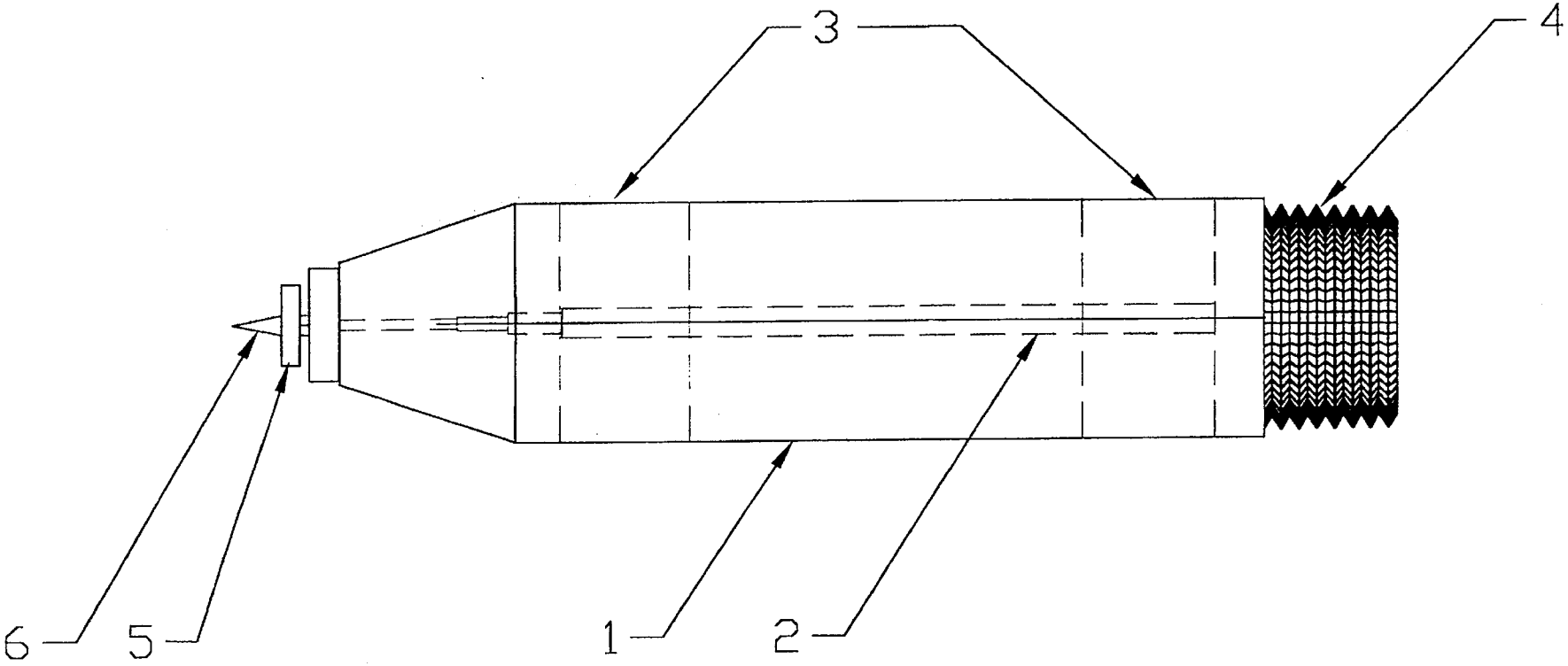
FIG. 1 is a side view of the Drop Finder showing the main body assembly, the telescopic shaft and shaft retainers, the marking-tip pointer, the pressure ring and the N.P.T. male thread of one inch diameter.

According to FIG. 1, the invention consists of one complete device with no detachable parts comprising a main body assembly 1 having within it a telescopic shaft 2 held within the main body assembly 1 by two shaft retainers 3. The telescopic shaft 2 when closed measures 5 inches or less and at full protraction measures 25 or more inches in length. The main body assembly 1, having a one inch N.P.T. male thread pipe 4, which engages the installed sprinkler system piping. The device may be constructed of plastic or PVC, fiberglass or metal. The telescopic shaft 2 has a marking-tip pointer 6 which when pressure is applied on the pressure ring 5, and it is pushed into the ceiling or wall, creates and indentation and or a mark.

Figure 2:
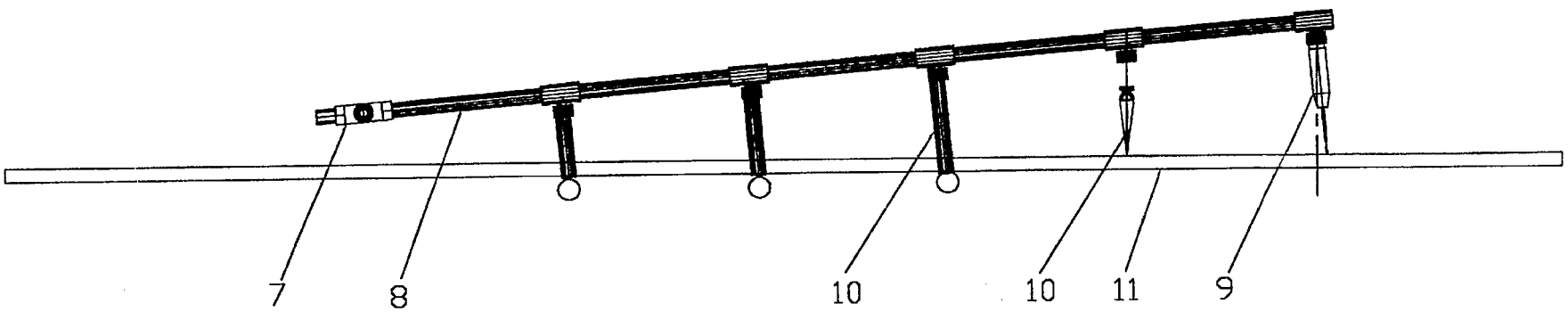
FIG. 2 is a schematic of the use of the Drop Finder for a dry sprinkler system installation having pitched pipe sprinkler lines.

According to FIG. 2, when a dry sprinkler system is installed in a space which is kept at below freezing, it is filled with air and must be pitched sufficiently so that when the sprinkler head is triggered, and the air is released, water will flow through the main feed line 7 from its source to the sprinkler heads. The installation of pitched plumbing poses difficulties in that measurement cannot be standardized and therefore the use of the Drop Finder is of great assistance. As FIG. 2 illustrates, the branch line 8 on the dry system is pitched so as to require varying lengths of pipes (known as drops) 10 which connect the pitched branch line to the ceiling 11 sprinkler heads. The Drop Finder 9 is used to mark the points where the holes for the sprinkler heads must be made in the ceiling 11.

Having described the preferred embodiment of the invention with reference to the accompanying drawing, it is to be understood that the invention is not limited to that precise embodiment and that various changes and modifications may be effected therein by one skilled in the art without departing from the scope and spirit of the invention as defined in the appended claims.

I claim:

1. A method of marking an extension point on a ceiling or wall during the installation of an interior sprinkler system, said sprinkler system consisting of sprinkler system piping, with the use of a device, said device comprises a main body assembly having two ends, one end having a male threaded pipe, said male threaded pipe being sized to match the sprinkler system piping and having on the other end a collapsible telescopic pointer, said telescopic pointer being protractible such that when closed it is engaged completely within said main body assembly and when extended reaches a length in excess of 25 inches, said telescopic pointer being held within said main body assembly by two shaft retainers spaced within said main body assembly, said telescopic pointer having two ends, one end being engaged within said main body assembly and the other end having a pressure ring and a pointed implement, consisting of the following steps:

(a) Engaging said one end of the main assembly having said male threaded pipe by inserting it within said sprinkler system piping and rotating the device until it is securely connected to said piping;

(b) Extending said telescopic pointer of the device until it reaches the ceiling or wall through which a hole will be drilled and into which a sprinkler head or additional piping will be installed;

(c) Applying pressure to said pressure ring of the telescopic pointer so as to mark the ceiling or wall with the pointed implement;

(d) Removing the device by disengaging it from the sprinkler system piping;

(e) Drilling the hole in the ceiling or wall at the point where the mark is made.

2. Apparatus for marking an extension point in connection with the installation of an interior sprinkler system, said sprinkler system consisting of sprinkler system piping, consisting of a main body assembly having two ends, on one of said ends having a male threaded pipe, said male threaded pipe being sized to match the sprinkler system piping, and having extending from the other of said ends a collapsible telescopic pointer which when protracted extends to a length in excess of 25 inches, said telescopic pointer having on one end a pressure ring and a pointed implement; said telescopic pointer being held within said main body assembly by two shaft retainers.

3. Apparatus as in claim 2 wherein said pointed implement comprises ink and means for marking a point with said ink.

* * * * *